US010738429B2

(12) United States Patent
Chen et al.

(10) Patent No.: US 10,738,429 B2
(45) Date of Patent: Aug. 11, 2020

(54) ASYMMETRIC DEBRIS FLOW DRAINAGE TROUGH AND DESIGN METHOD AND APPLICATION THEREOF

(71) Applicant: Institute of Mountain Hazards and Environment, Chinese Academy of Sciences, Sichuan (CN)

(72) Inventors: Jiangang Chen, Sichuan (CN); Xiaoqing Chen, Sichuan (CN); Wanyu Zhao, Sichuan (CN); Yong You, Sichuan (CN); Kai Hu, Sichuan (CN); Daozheng Wang, Sichuan (CN)

(73) Assignee: Institute of Mountain Hazards and Environment, Chinese Academy of Sciences, Sichuan (CN)

( * ) Notice: Subject to any disclaimer, the term of this patent is extended or adjusted under 35 U.S.C. 154(b) by 0 days.

(21) Appl. No.: 16/098,272

(22) PCT Filed: May 26, 2016

(86) PCT No.: PCT/CN2016/083443
§ 371 (c)(1),
(2) Date: Nov. 1, 2018

(87) PCT Pub. No.: WO2017/193422
PCT Pub. Date: Nov. 16, 2017

(65) Prior Publication Data

US 2019/0161929 A1 May 30, 2019

(30) Foreign Application Priority Data

May 13, 2016 (CN) ..... 2016 1 0321178

(51) Int. Cl.
*E02B 13/00* (2006.01)
*E02B 3/02* (2006.01)
(Continued)

(52) U.S. Cl.
CPC ..... *E02B 3/02* (2013.01); *E02B 3/04* (2013.01); *E02B 5/00* (2013.01); *E02B 5/02* (2013.01); *E03F 1/00* (2013.01); *E02B 11/005* (2013.01)

(58) Field of Classification Search
CPC ..... E02B 13/00; E02B 11/005; E02B 5/00; E01C 11/22
(Continued)

(56) References Cited

U.S. PATENT DOCUMENTS 6,079,903 A * 6/2000 Wagner ..... E03F 1/002 404/4
8,517,633 B2 8/2013 Cui et al.

FOREIGN PATENT DOCUMENTS

CN 102002927 A 4/2011
CN 102086635 B 1/2012
(Continued)

OTHER PUBLICATIONS

International Search Report issued in corresponding International application No. PCT/CN2016/083443 dated Feb. 17, 2017.

*Primary Examiner* — Sunil Singh
(74) *Attorney, Agent, or Firm* — Scully Scott Murphy & Presser

(57) ABSTRACT

An asymmetric debris-flow discharge channel is provided. The debris-flow discharge channel has a main drainage channel for discharging a debris flow and an auxiliary channel provided outside of the main drainage channel. The side walls of the auxiliary channel are integrated with the side walls of the main drainage channel or provided outside of the side walls of the main drainage channel. The debris-flow discharge channel also has a break section integrated into a side wall of the auxiliary channel. The top width of the break section is equal to the top width of the auxiliary channel A method for designing and building the asymmet-
(Continued)

ric debris-flow discharge channel is also provided, which provides a lower initial cost, higher safety performance, and a lower maintenance cost at the operating stage.

7 Claims, 3 Drawing Sheets

(51) Int. Cl.

| | |
|---|---|
| ***E02B 5/00*** | (2006.01) |
| ***E03F 1/00*** | (2006.01) |
| ***E02B 5/02*** | (2006.01) |
| ***E02B 3/04*** | (2006.01) |
| *E02B 11/00* | (2006.01) |

(58) Field of Classification Search
USPC ..... 405/119; 404/2, 4
See application file for complete search history.

(56) References Cited

FOREIGN PATENT DOCUMENTS

| | | | |
|---|---|---|---|
| CN | 104794362 | A | 7/2015 |
| CN | 104848825 | A | 8/2015 |
| CN | 105256768 | A | 1/2016 |
| RU | 2006 115 861 | A | 11/2001 |
| RU | 2 188 892 | C2 | 9/2002 |

* cited by examiner

ASYMMETRIC DEBRIS FLOW DRAINAGE TROUGH AND DESIGN METHOD AND APPLICATION THEREOF

BACKGROUND OF THE INVENTION

This invention is a form of debris-flow control engineering that specifically relates to the design and application of an asymmetric debris-flow drainage channel that is used in special conditions in which the protected objects on both sides of the drainage channel have different design standards. Debris flow is one of the major geological hazards in the world, and the demand for debris-flow control engineering is increasing rapidly. Drainage channels are one of the main types of debris-flow control structures and are widely used in debris-flow hazard mitigation. At present, debris-flow drainage channels are completely symmetrical in terms of both structural design and materials used, a configuration that ignores the differences in the design standards of the objects that are to be protected on either side of the drainage channel. To accommodate the different design and protection standards that can be required on each side of a drainage channel using a symmetrical debris-flow drainage channel can easily result in excessive construction work and material waste. Furthermore, under low frequency debris flows of large-scale and high discharge, the debris-flow depth can exceed the height of the side wall of the drainage channel, overflowing the channel and destroying the area to be protected (settlements, buildings, factories, etc.) on both sides of the drainage channel.

SUMMARY OF THE INVENTION

In order to overcome the shortcomings of existing design methods, this invention provides a design method for a new type of asymmetric debris-flow drainage channel. Its design and application are based on the design standards for the protection of objects on both sides of the channel, effectively solving the issue of differing design standards while providing a lower initial cost, higher safety performance, and lower maintenance cost at the operating stage. The proposed design method is especially suitable for protecting areas with limited economic activity and resources.

To achieve this purpose, the technical scheme of the invention is as follows:

The invention provides a design method for an asymmetric debris-flow drainage channel that consists of a main drainage channel for carrying debris flow below the designed discharge and an auxiliary drainage channel to carry the debris flow when it exceeds the design discharge. The main channel can be constructed as a full lining type, Dongchuan-type, or step-pool type channel, among others. The side wall of the auxiliary channel can either be shared with that of the main channel such that the width of the auxiliary channel $B_2$ is equal to the width $B_1$ of the main channel, or the side wall of the auxiliary channel can be located outside of the side wall of the main channel such that the width $B_2$ of the auxiliary channel is wider than the width $B_1$ of the main channel. A portion of the auxiliary channel side wall on the side with the lower design standard is used as a break section, in which the top width $b_0$ of the break section is equal to the top width b of the auxiliary channel side wall.

The building material of the break section is different from that of the side wall of the auxiliary channel. The side wall of the auxiliary channel can be made of conventional reinforced concrete or high-strength concrete. However, the break section can be made of masonry, gabions, or concrete with a lower strength than the auxiliary channel side wall, ensuring that the break section will collapse readily when required to discharge any debris flow in excess of channel design capacity.

The cross section of the break section is rectangular while that of the auxiliary drainage channel can be either trapezoidal or rectangular. The top width of the break section is 0.5-1.5 m, and the thickness of the auxiliary channel wall is 0.5-1.5 m. The building materials of the side wall of the main channel are reinforced concrete or plain concrete with a side wall thickness of 0.5-1.5 m.

The characteristics of the asymmetric debris-flow drainage channel are linked to the asymmetry of the building materials of the auxiliary channel walls, as well as the asymmetry of the objects to be protected on each side of the drainage channel. The main channel is designed to safely discharge a debris flow within the design scale. When the debris-flow discharge in the channels exceeds the design scale, the side wall of the auxiliary channel on the side with the lower design standard is allowed to automatically collapse. The debris flow in excess of the design capacity of the main and auxiliary channels is then discharged into a sediment storage basin or farmland on the side with the lower design standard. As a result, this invention effectively guarantees the safety of the people, property, and infrastructure in the villages and towns on the side with the higher design standard, reducing the damage caused by debris flow.

The design method of the asymmetric debris-flow drainage channel is as follows:

Step 1: Determine the debris-flow density $\gamma_{debris\ flow}$ (unit: $kN/m^3$) through field surveying and measurements. Then, determine the debris-flow peak discharge $Q_{total}$ (unit: $m^3/s$) under the design standard using the small-watershed hydrologic calculation method. Next, determine the peak flood discharge under the design standard using the same method. Then, determine the critical debris-flow peak discharge $Q_{main\ river}$ (unit: $m^3/s$) that will block the river into which the drainage channel discharges. A detailed method for determining $Q_{total}$ and $Q_{main\ river}$ can be found in "Method of debris flow prevention based on controlling the transport of the main river" (Patent No. ZL 201010617466.8).

Step 2: Determine the construction material of the break section through field surveying and measurements. Then, determine the density of the break section $\gamma_{break\ section}$ (unit: $kN/m^3$) according to the selected material. Next, determine the top width of the break section $b_0$ (unit: m) and the height $h_2$ of auxiliary channel (unit: m) according to the results of the field survey.

Step 3: Determine the debris-flow depth $h_{debris\text{-}flow\ depth}$ (unit: m) in the auxiliary channel using the discharge design standard with the cross-section superposition method for calculating water flow discharge in a compound river channel, or an equation for calculating the debris-flow discharge in a drainage channel. The break section is designed to automatically collapse when the debris-flow depth in the auxiliary channel reaches this design value.

Step 4: The length $L_0$ of the break section can be determined by the following equation:

$$L_0 = \frac{Q_{total} - Q_{main\ river}}{\varphi\sqrt{2g}\, h_{debris\text{-}flow\ depth}^{3/2}}$$

where:

$L_0$=length of the break section (unit: m), $Q_{total}$=debris-flow peak discharge (unit: $m^3/s$) under the design standard, determined in Step 1;

$Q_{main\ river}$=critical debris-flow peak discharge (unit: $m^3/s$) required to block the river into which the channel discharges, as determined in Step 1;

φ=comprehensive coefficient determined by the debris-flow properties, which decreases as the debris-flow density increases, with values ranging from 0.2 to 0.5;

g=acceleration due to gravity (approximately 9.81 $m/s^2$);

$h_{debris\text{-}flow\ depth}$=the debris-flow depth (unit: m) in the auxiliary channel of the designed drainage channel under the discharge design standard determined in Step 3.

Step 5: The height $h_0$ of the break section must be smaller than the height of the auxiliary channel $h_2$ (as determined in Step 2), and is otherwise calculated by:

$$h_{debris\text{-}flow\ depth} < h_0 < \frac{\gamma_{debris\ flow} \times h^3_{debris\text{-}flow\ depth}}{3(\gamma_{break\ section} \times b_0^2)}$$

where:

$h_0$=height of the break section (unit: m);

$h_{debris\text{-}flow\ depth}$=debris-flow depth (unit: m) in the auxiliary channel of the drainage channel under the discharge design standard determined in Step 3;

$\gamma_{break\ section}$=density of the break section (unit: $kN/m^3$) determined in Step 2;

$\gamma_{debris\ flow}$=debris-flow density (unit: $kN/m^3$) determined in Step 1;

$b_0$=top width of break section (unit: m) determined in Step 2;

This method for designing the asymmetric debris-flow drainage channel is applicable for the protection of objects with different design protection standards on each side of a drainage channel, and is applicable in gullies with longitudinal slopes between 0.05 and 0.30 and for debris-flow densities between 15 $kN/m^3$ and 21 $kN/m^3$.

Compared with existing technologies, the beneficial effects of the presently proposed asymmetric debris-flow drainage channel are: full consideration of the different design protection standards on each side of the drainage channel, the length of the break section is established considering the selection of building material on the side with the lower protection design standard, and corresponding deposition facilities can be established downstream of the break section. At lower debris flow rates, the asymmetric debris-flow drainage channel break section remains intact, protecting all objects in the debris-flow fan. Because the material of the break section is different from the material of the rest of the auxiliary channel side wall, its construction requires fewer material and financial resources, is less manpower intensive, and effectively disposes of the debris flow on a large scale. Additionally, it is easy to restore and rebuild the break section after collapse, effectively reducing the operating cost of the drainage channel.

| | |
|---|---|
| 1 = main channel | 2 = auxiliary channel |
| 3 = main channel side walls | 4 = auxiliary channel side walls |
| 5 = break section | |
| $B_1$ = width of the main channel | $B_2$ = width of the auxiliary channel |
| $h_1$ = height of the main channel | $h_2$ = height of the auxiliary channel |
| $H_0$ = height of the break section | $L_0$ = length of the break section |
| $b_0$ = top width of the break section | |
| b = top width of the auxiliary channel side wall | |
| $h_{debris\text{-}flow\ depth}$ = debris-flow depth in the auxiliary channel at the discharge design standard | |

DESCRIPTION OF THE EMBODIMENTS

Embodiment 1

Figure 1:
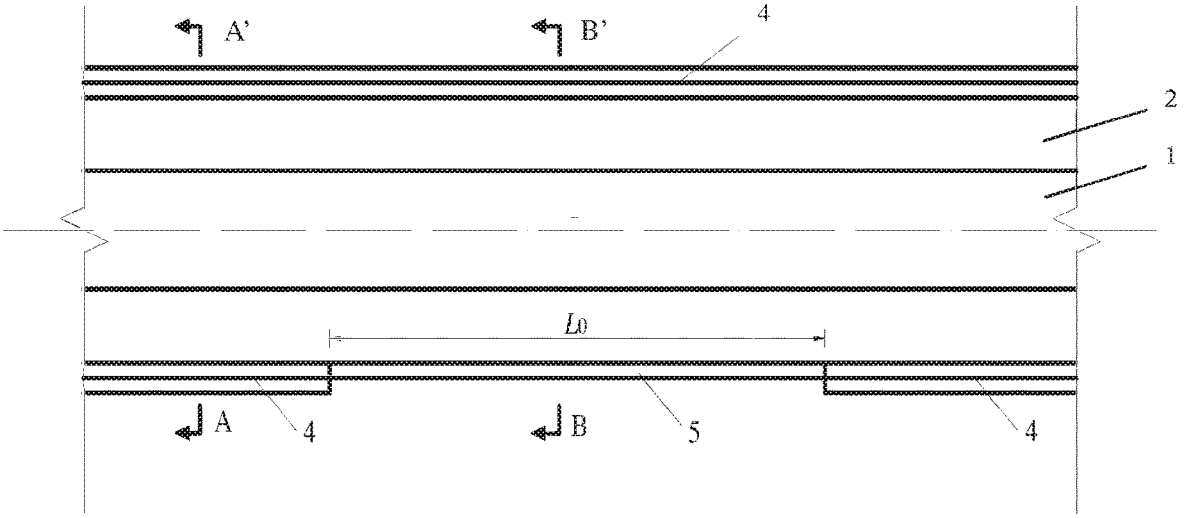
FIG. 1 is a schematic top view of the present invention in Embodiment 1.
Figure 2:
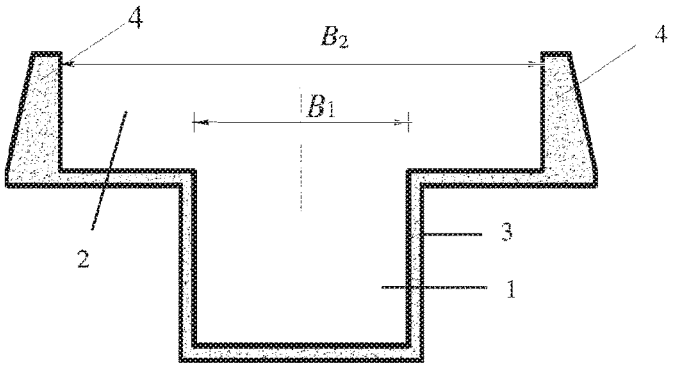
FIG. 2 is a schematic diagram of cross-section A-A' in FIG. 1.
Figure 3:
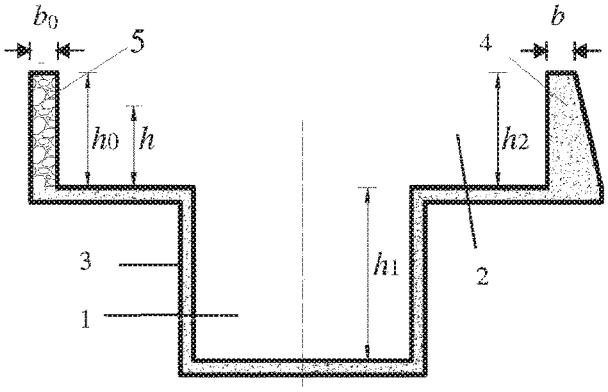
FIG. 3 is a schematic diagram of cross-section B-B' in FIG. 1.

Embodiment 1 of the invented asymmetric debris-flow drainage channel is shown in FIGS. 1, 2, and 3. The area of the debris-flow drainage basin is 14 $km^2$ and its mean longitudinal slope is 0.05. According to the distribution pattern of villages and towns on the debris-flow deposition fan, an asymmetric debris-flow drainage channel is proposed using the invention to discharge a debris flow triggered in the basin while protecting objects on each side of the channel with different design standards. Debris-flow mitigation can thus be conducted by means of asymmetric drainage engineering measures on the basis of fully utilizing the transport capacity of the main river downstream of the basin.

According on the topographic conditions of the debris-flow deposition fan and the distribution of villages, towns, and farmlands upon it obtained from field surveys, the length of the drainage channel to be built is 480.0 m. This asymmetric debris-flow drainage channel consists of the main channel (1) to discharge the debris flow within the design standard, and the auxiliary channel (2) to discharge flow in excess of the design standard. The auxiliary channel side walls (4) are located outside of the main channel side walls (3). The height $h_1$ and width $B_1$ of the main channel are 2.5 m and 3.0 m, respectively. The side walls of the main channel are made of reinforced concrete with a thickness of 0.5 m. The height $h_2$ and width $B_2$ of the auxiliary channel are 2.5 m and 7.0 m, respectively. The break section (5) in the side wall of the auxiliary channel is designed to a lower protection standard. The break section (5) is rectangular in section, while that of the auxiliary channel (4) is trapezoidal. The top width, $b_0$, of the break section (5) is 0.5 m, the same as the top width of the auxiliary channel (4), b. The side walls of the auxiliary channel (4) are made of reinforced concrete, while the break section (5) is constructed of M7.5 masonry.

The design procedure of this asymmetric debris-flow drainage channel is as follows:

Step 1: Through field surveys, the debris-flow density $\gamma_d$ is determined to be 17 kN/m$^3$. According to the small-watershed hydrologic calculation method, the total peak discharge of the debris flow $Q_{total}$ under the design standard for a 5% frequency is 480 m$^3$/s. The peak flood discharge of the main river under the design standard can also be determined using the same method. According to the peak flood discharge of the main river under the design standard, the critical peak debris-flow discharge $Q_{main\ river}$ of the drainage channel that will block the main river is determined to be 300 m$^3$/s.

Step 2: Based on the actual site conditions, the material of the break section (5) is selected to be M7.5 masonry with a density of 22 kN/m$^3$ and a top width $b_0$ of 0.5 m. The height of the auxiliary channel $h_2$ is 2.5 m.

Step 3: According to the method of cross-section superposition for calculating the discharge in a compound channel, the debris-flow depth in the auxiliary channel $h_{debris\text{-}flow\ depth}$=1.5 m when the debris flow reaches the main river under the design standard.

Step 4: When the debris-flow peak discharge exceeds the maximum allowable peak discharge ($Q_{total}$) of the entire drainage channel, the break section (5) of the auxiliary channel side wall (4) automatically breaks and the debris flow in excess of the design standard is then discharged directly onto the side with the lower design protection standard. The length of the break section (5) $L_0$ can be determined by:

$$L_0 = \frac{Q_{total} - Q_{main\ river}}{\varphi\sqrt{2g}\,h^{3/2}_{debris\text{-}flow\ depth}} = \frac{480 - 300}{0.4 \times \sqrt{2 \times 9.81} \times 1.5^{3/2}} = 55.3m$$

The safety factor of the break section (5) be 1.1, so the $L_0$ in the final engineering design should be rounded up to 61.0 m.

Step 5: When the debris-flow depth in the auxiliary channel (2) reaches the design value ($h_{debris\text{-}flow\ depth}$), break section (5) automatically breaks. The required height $h_0$ of the break section (5) can be determined by:

$$h_{debris\ flow\ depth} < h_0 < \frac{\gamma_d \times h^3_{debris\ flow\ depth}}{3(\gamma_{outburst} \times b_0^2)}$$

$$1.5m < h_0 < \frac{17 \times 1.5^3}{3 \times (22 \times 0.5^2)} = 3.5m$$

Considering that the required height $h_0$ of the break section (5) must be smaller than that of the auxiliary channel (2), $h_2$, namely, 1.5 m<$h_0$<2.5 m, the height of the break section (5) is set to 2.0 m in the final engineering design.

Embodiment 2

Figure 4:
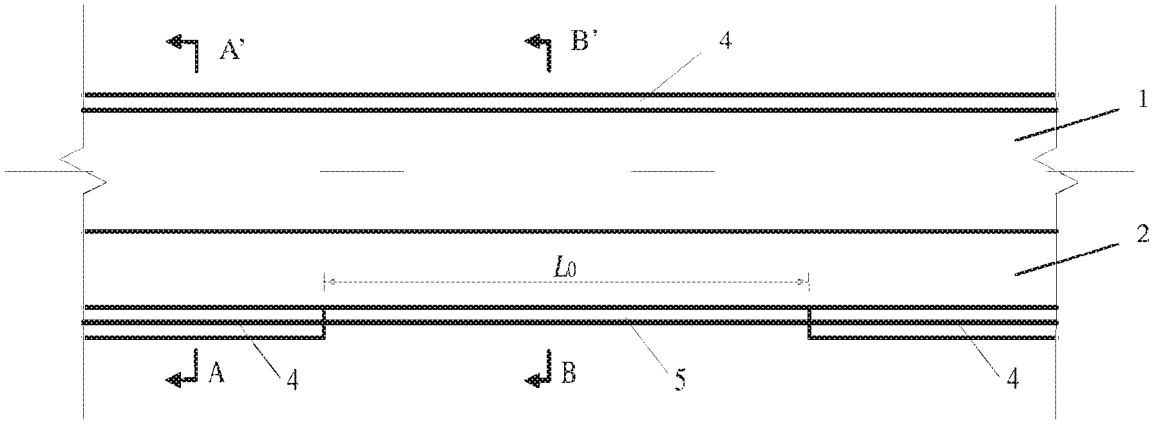
FIG. 4 is a schematic top view of the present invention in Embodiment 2.
Figure 5:
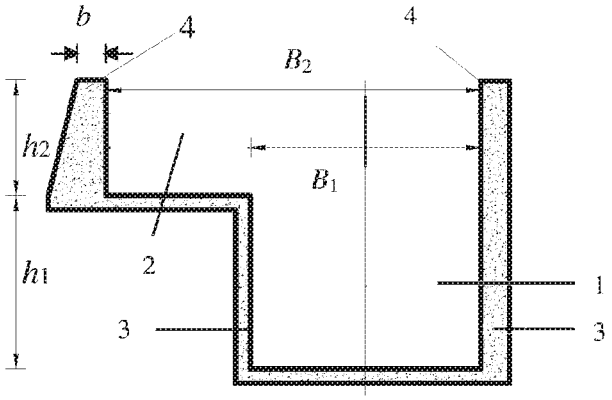
FIG. 5 is a schematic diagram of cross-section A-A' in FIG. 4.
Figure 6:
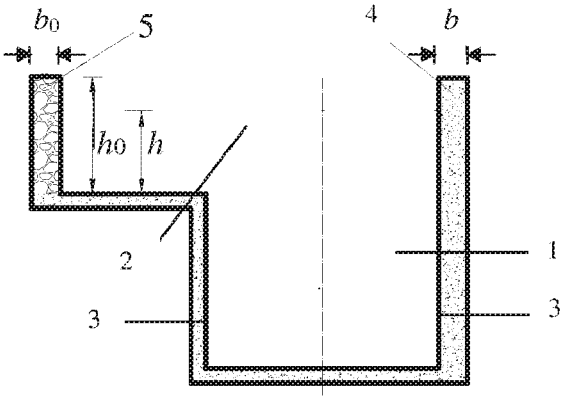
FIG. 6 is a schematic diagram of cross-section B-B' in FIG. 4.

Embodiment 2 of the invented asymmetric debris-flow drainage channel is shown in FIGS. 4, 5, and 6. The area of the debris-flow gully is 24 km$^2$, and its mean longitudinal slope is 0.20. According to the distribution pattern of villages and towns on the debris-flow deposition fan, an asymmetric debris-flow drainage channel is proposed using the invention in to discharge a debris flow triggered in the basin while protecting objects on each side of the channel with different design standards. Debris-flow mitigation can be conducted by means of asymmetric drainage engineering measures on the basis of fully utilizing the transport capacity of the main river downstream of the basin.

According to the topographic conditions of the debris-flow deposition fan and the distribution of villages, towns, and farmlands upon it obtained from field surveys, the length of drainage channel to be built is 980.0 m. This asymmetric debris-flow drainage channel consists of the main channel (1) to discharge the debris flow within the design standard and the auxiliary channel (2) to discharge flow in excess of the design standard. The auxiliary channel side walls (4) are located outside of the main channel side walls (3). The height $h_1$ and width $B_1$ of the main channel are 5.0 m and 8.0 m, respectively. The side walls of the main channel are made of reinforced concrete with a thickness of 1.0 m. The height $h_2$ and width $B_2$ of the auxiliary channel are 3.5 m and 16.0 m, respectively. The break section (5) in the side wall of the auxiliary channel is designed to a lower protection standard. The break section (5) is rectangular in section, while the auxiliary channel (4) section is trapezoidal. The top width, $b_0$, of the break section (5) is 1.0 m, the same as the top width of the auxiliary channel (4), b. The side walls of the auxiliary channel (4) are made of reinforced concrete while the break section (5) is constructed of gabions, which are rock-filled stone cages.

The design procedure of this asymmetric debris-flow drainage channel is as follows:

Step 1: Through field surveys, the debris-flow density $\gamma_d$ is determined to be 21 kN/m$^3$. According to the small-watershed hydrologic calculation method, the total peak discharge of the debris flow $Q_{total}$ under the design standard for a 2% frequency is 1245 m$^3$/s. The peak flood discharge of the main river under the design standard can also be determined using the same method. According to the peak flood discharge of the main river under the design standard, the critical peak debris-flow discharge $Q_{main\ river}$ of the drainage channel that will block the main river is determined to be 834 m$^3$/s.

Step 2: Based on the actual site conditions, the material of the break section (5) is selected to be gabions with a density of 20 kN/m$^3$ and a top width $b_0$ of 1.0 m. The height of auxiliary channel $h_2$ is 3.5 m.

Step 3: According to the method of cross-section superposition for calculating the discharge in a compound channel, the debris-flow depth in the auxiliary channel $h_{debris\text{-}flow\ depth}$=2.0 m when the debris flow reaches the main river under the design standard.

Step 4: When the debris-flow peak discharge exceeds the maximum allowable peak discharge ($Q_{total}$) of the entire drainage channel, the break section (5) of the auxiliary channel side wall (4) automatically breaks and the debris flow in excess of the design standard is then discharged directly to the side with the lower design standard. The length of the break section (5) $L_0$ can be determined by:

$$L_0 = \frac{Q_{total} - Q_{main\ river}}{\varphi\sqrt{2g}\,h^{3/2}_{debris\ flow\ depth}} = \frac{1245 - 834}{0.2 \times \sqrt{2 \times 9.81} \times 2.0^{3/2}} = 164.0m$$

The safety factor of the break section (5) must be 1.1, so the $L_0$ in the final engineering design should be rounded to 180.0 m.

Step 5: When the debris-flow depth in the auxiliary channel reaches the design value (that is $h_{debris\text{-}flow\ depth}$), the break section (5) automatically breaks. The height $h_0$ of the break section (5) can be determined by:

$$h_{debris\ flow\ depth} < h_0 < \frac{\gamma_d \times h^3_{debris\ flow\ depth}}{3(\gamma_{outburst} \times b_0^2)}$$

$$2.0m < h_0 < \frac{21 \times 2.0^3}{3 \times (20 \times 1.0^2)} = 2.8m$$

Considering that the required height $h_0$ of the break section (5) must be smaller than that of the auxiliary channel (2), $h_2$, namely, 2.0 m<$h_0$<2.8 m, the height of the break section 5 is set to 2.2 m in the final engineering design.

Embodiment 3

Figure 7:
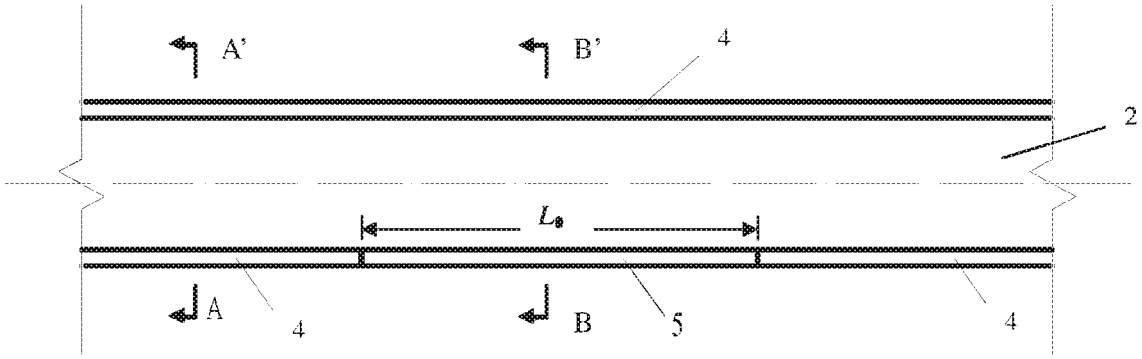
FIG. 7 is a schematic top view of the present invention in Embodiment 3.
Figure 8:
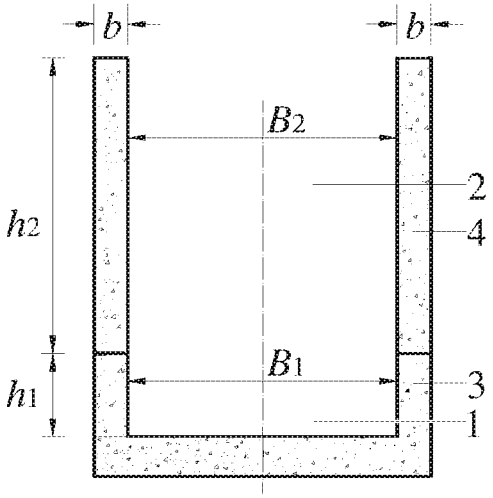
FIG. 8 is a schematic diagram of cross-section A-A' in FIG. 7.
Figure 9:
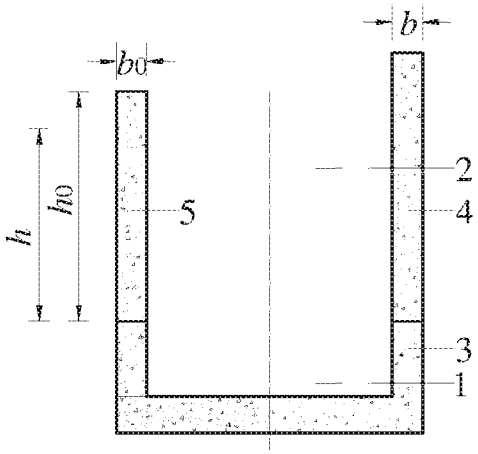
FIG. 9 is a schematic diagram of cross-section B-B' in FIG. 7.

Embodiment 3 of the invented asymmetric debris-flow drainage channel is shown in FIGS. 7, 8, and 9. The area of the debris-flow drainage basin is 16 $km^2$ and its mean longitudinal slope is 0.30. According to the distribution pattern of villages and towns on the debris-flow deposition fan, an asymmetric debris-flow drainage channel is proposed using the invention to discharge a debris flow triggered in the basin while protecting objects on each side of the channel with different design standards. Debris-flow mitigation can be conducted by means of asymmetric drainage engineering measures on the basis of fully utilizing the transport capacity of the main river downstream of the basin.

According to the topographic conditions of debris-flow deposition fan and the distribution of villages, towns, and farmlands upon it obtained from field surveys, the length of the drainage channel to be built is 580.0 m. This asymmetric debris-flow drainage channel consists of the main channel (1) to discharge the debris flow within the design standard, and the auxiliary channel (2) to discharge flow in excess of the design standard. The auxiliary channel side walls (4) are located outside of the main channel side walls (3). The height $h_1$ and width $B_1$ of the main channel are 1.0 m and 8.0 m, respectively. The side walls of the main channel are made of high-grade C30 concrete with a thickness of 1.5 m. The height $h_2$ and width $B_2$ of the auxiliary channel are 6.0 m and 8.0 m, respectively. The break section (5) in the side wall of the auxiliary channel is designed to a lower protection standard. The break section (5) is rectangular in section, as is the auxiliary channel (4). The top width, $b_0$, of the break section (5) is 0.5 m, which is the same as the top width of the auxiliary channel (4), b. The side walls of the auxiliary channel (4) are made of high-grade C30 concrete, while the break section (5) is constructed of low-grade C20 concrete.

The design procedure of this asymmetric debris-flow drainage channel is as follows:

Step 1: Through field surveys, the debris-flow density $\gamma_d$ is determined to be 15 $kN/m^3$. According to the small-watershed hydrologic calculation method, the total peak discharge of the debris flow $Q_{total}$ under the design standard for a 2% frequency is 975 $m^3/s$. The peak flood discharge of the main river under the design standard can also be determined using the same method. According to the peak flood discharge of the main river under the design standard, the critical peak debris-flow discharge $Q_{main\ river}$ of the drainage channel that will block the main river is determined to be 360 $m^3/s$.

Step 2: Based on the site actual conditions, the material of the break section (5) is selected to be C20 concrete with a density of 23 $kN/m^3$ and a top width $b_0$ of 1.5 m. The height of the auxiliary channel $h_2$ is 6.0 m.

Step 3: According to the method of cross-section superposition for calculating the discharge in a compound channel, the debris-flow depth in the auxiliary channel $h_{debris\text{-}flow\ depth}$=4.5 m when the debris flow reaches the main river under the design standard.

Step 4: When the debris-flow peak discharge exceeds the maximum allowable peak discharge ($Q_{total}$) of the entire drainage channel, the break section (5) of the auxiliary channel side wall (4) automatically breaks and the debris flow in excess of the design standard is then be discharged directly onto the side with the lower design protection standard. The length $L_0$ of the break section (5) can be determined by:

$$L_0 = \frac{Q_{total} - Q_{main\ river}}{\varphi\sqrt{2g}\ h^{3/2}_{debris\ flow\ depth}} = \frac{975 - 360}{0.5 \times \sqrt{2 \times 9.81} \times 4.5^{3/2}} = 29.1m$$

The safety factor of the break section (5) must be 1.1, so the $L_0$ in the final engineering design should be rounded up to 32.0 m.

Step 5: When the debris-flow depth in the auxiliary channel (2) reaches the design value ($h_{debris\text{-}flow\ depth}$), the break section (5) automatically breaks. The required height $h_0$ of the break section (5) can be determined by:

$$h_{debris\ flow\ depth} < h_0 < \frac{\gamma_d \times h^3_{debris\ flow\ depth}}{3(\gamma_{outburst} \times b_0^2)}$$

$$4.5m < h_0 < \frac{15 \times 4.5^3}{3 \times (23 \times 1.5^2)} = 8.8m$$

Considering that the height $h_0$ of the break section (5) must be smaller than that of the auxiliary channel (2), $h_2$, namely, 4.5 m<$h_0$<6.0 m, the height of the break section (5) is set to 5.0 m in the final engineering design.

We claim:

1. An asymmetric debris-flow discharge channel comprising:

a main drainage channel for discharging a debris flow according to a predetermined standard, wherein the main drainage channel comprises side walls;

an auxiliary channel provided outside of the main drainage channel, wherein the auxiliary channel comprises side walls that are integrated with the side walls of the main drainage channel or provided outside of the side walls of the main drainage channel, wherein the auxiliary channel has a top width defined by the side walls of the auxiliary channel; and a break section integrated into a side wall of the auxiliary channel, wherein the break section has a top width, wherein the top width of the break section is equal to the top width of the auxiliary channel;

wherein the side walls of the auxiliary channel are made of a first building material and the break section is made of a second building material that is different from the first building material;

wherein the break section has a first strength defined by the first building material and the side walls of the auxiliary channel has a second strength defined the second building material; and wherein the first strength is weaker than the second strength, such that when a load applied by the debris flow exceeds a predetermined value, the break section collapses and the sidewalls of the auxiliary channel maintains integral to allow a part of the debris flow to exit the auxiliary channel, the asymmetric debris-flow discharge channel further comprising a storage structure adjacent the break section for storing the part of the debris flow.

2. The asymmetric debris-flow discharge channel according to claim 1, wherein the break section has a cross section that is rectangular.

3. The asymmetric debris-flow discharge channel according to claim 1, wherein the auxiliary channel has a cross section that is trapezoidal or rectangular.

4. The asymmetric debris-flow discharge channel according to claim 1, wherein the side walls of the auxiliary channel is made of reinforced concrete or concrete.

5. The asymmetric debris-flow discharge channel according to claim 1, wherein the top width of the break section is in a range of 0.5 m to 1.5 m and the top width of the auxiliary channel is in a range of 0.5 m to 1.5 m.

6. The asymmetric debris-flow discharge channel according to claim 1, wherein the side walls of the main drainage channel are made of reinforced concrete or concrete and wherein the main drainage channel has a width in a range of 0.5 m to 1.5 m.

7. A method of building an asymmetric debris-flow discharge channel, the method comprising:

step 1:

determining a debris-flow density $\gamma_{debris\ flow}$ in the unit of kN/m$^3$ through on-site survey and measuring, determining a debris-flow peak discharge $Q_{total}$ in the unit of m$^3$/s by using a small-watershed hydrologic calculation method, determining a peak flood discharge by using the small-watershed hydrologic calculation method, and determining a critical debris flow peak discharge $Q_{main\ river}$ in the unit of m$^3$/s based on the determined peak flood discharge, wherein the critical debris-flow peak discharge is the volume of a debris flow that causes blockage of a river when the debris flow is discharged into the river from the drainage channel;

step 2:

determining a building material of a break section of the asymmetric debris-flow discharge channel through on-site survey and measuring, determining a density of the break section $\gamma_{break\ section}$ in the unit of kN/m$^3$ according to the determined building material, and determining a top width of the break section $b_0$ in the unit of m and a height $h_2$ of an auxiliary channel of the asymmetric debris-flow discharge channel in the unit of m through on-site survey and measuring;

step 3:

determining a debris-flow depth $h_{debris\text{-}flow\ depth}$ in the unit of m in the auxiliary channel using a method of cross-section superposition for calculating the discharge in a compound channel;

step 4:

determining a length $L_0$ of the break section by using the following equation:

$$L_0 = \frac{Q_{total} - Q_{main\ river}}{\varphi\sqrt{2g}\, h_{debris\text{-}flow\ depth}^{3/2}}$$

wherein:

$L_0$=the length of the break section in the unit of m, $Q_{total}$=the debris-flow peak discharge determined in step 1, $Q_{main\ river}$=the critical debris-flow peak discharge determined in step 1, $\varphi$=a comprehensive coefficient ranging from 0.2 to 0.5, g=acceleration due to gravity, and $h_{debris\text{-}flow\ depth}$=the debris-flow depth determined in step 3; and step 5:

calculating a height $h_0$ of the break section by using the following equation, under the condition that $h_0<h_2$:

$$h_{debris\text{-}flow\ depth} < h_0 < \frac{\gamma_{debris\ flow} \times h_{debris\text{-}flow\ depth}^3}{3(\gamma_{break\ section} \times b_0^2)}$$

wherein:

$h_0$=the height of the break section in the unit of m, $h_{debris\text{-}flow\ depth}$=the debris-flow depth determined in step 3, $\gamma_{break\ section}$=the density of the break section determined in step 2, $\gamma_{debris\ flow}$=the debris-flow density determined in step 1, and $b_0$=the top width of the break section determined in step 2.

* * * * *